US005899135A

United States Patent [19]

Kanou et al.

[11] Patent Number: 5,899,135

[45] Date of Patent: May 4, 1999

[54] RECIPROCATING PISTONS OF PISTON TYPE COMPRESSOR

[75] Inventors: Hiroshi Kanou; Shigemi Shimizu, both of Gunma, Japan

[73] Assignee: Sanden Corporation, Gunma, Japan

[21] Appl. No.: 08/856,810

[22] Filed: May 15, 1997

[30] Foreign Application Priority Data

May 21, 1996 [JP] Japan ..... 8-125311

[51] Int. Cl.[6] ..... F01B 3/00

[52] U.S. Cl. ..... 92/71; 92/172

[58] Field of Search ..... 91/499; 92/12.2, 92/71, 172

[56] References Cited

U.S. PATENT DOCUMENTS

| | | | |
|---|---|---|---|
| 1,229,009 | 6/1917 | Allison . | |
| 1,781,068 | 11/1930 | Michell . | |
| 2,048,272 | 11/1936 | Linthicum . | |
| 2,300,009 | 10/1942 | Rose | 92/172 |
| 4,108,048 | 8/1978 | Gauss et al. | 91/499 |
| 4,789,311 | 12/1988 | Ikeda et al. . | |
| 5,002,466 | 3/1991 | Inagaki et al. . | |
| 5,032,060 | 7/1991 | Kobayashi et al. . | |
| 5,174,728 | 12/1992 | Kimura et al. | 92/71 |
| 5,316,446 | 5/1994 | Kimura et al. . | |
| 5,382,139 | 1/1995 | Kawaguchi et al. | 417/269 |
| 5,461,967 | 10/1995 | Burkett et al. | 92/71 |
| 5,490,767 | 2/1996 | Kanou et al. . | |

FOREIGN PATENT DOCUMENTS

| | | |
|---|---|---|
| 0259760 | 3/1988 | European Pat. Off. . |
| 4207186 | 9/1992 | Germany . |
| 7-189897 | 7/1995 | Japan . |
| 7-189898 | 7/1995 | Japan . |

*Primary Examiner*—F. Daniel Lopez
*Attorney, Agent, or Firm*—Baker & Botts, L.L.P.

[57] ABSTRACT

A piston type compressor comprises a compressor housing enclosing a crank chamber, suction chamber, and a discharge chamber therein. A plurality of pistons are slidably disposed within each of cylinders formed in a cylinder block. Each of the pistons includes a piston head, a piston end, a main cylindrical body and an engaging portion at the piston end axially extending from the cylindrical body. A first aperture is formed in the cylindrical body of the piston, so that the first aperture is near the piston head of the piston. A second aperture is formed in the cylindrical body of the piston so that the second aperture is near the piston end of the piston. The first aperture is positioned within the cylinder bore when the piston reciprocates in the cylinder bore. As a result, the piston type compressor of the present invention has a light weight piston which simultaneously reduces abrasion between the piston and the cylinder bore and reduces noise and vibration.

10 Claims, 5 Drawing Sheets

RECIPROCATING PISTONS OF PISTON TYPE COMPRESSOR

BACKGROUND OF THE INVENTION

1. Field of the Invention

The present invention relates to a piston type compressor, in which fluid is compressed by means of reciprocating pistons connected to a swash plate. More particularly, it relates to improvements in the reciprocating pistons in the refrigerant compressor of an automotive air-conditioning system, such that both the weight of the pistons and abrasion to the pistons is reduced.

2. Description of Related Art

Variable capacity swash plate type compressors are known in the art. A typical conventional variable capacity swash plate type compressor is disclosed in Unexamined Japanese Patent Publication No. H7-189898, which disclosure is incorporated herein by reference.

Referring to FIG. 1, which depicts a variable capacity swash plate type compressor, a front housing 12 of the compressor is connected to the front end of a center housing 11. A rear housing 13 is connected to the rear end of center housing 11, with a valve plate 19 interposed therebetween. A cylinder block 11*b* is accommodated on the center housing 11. A plurality of cylinder bores 11*a* are equiangularly formed in the cylinder block 11*b*. A crank chamber 25 is defined in center housing 11 by cylinder block 11*b*. A drive shaft 14 is rotatably supported by means of radial bearing 22 disposed in front housing 12 and cylinder block 11*b*, respectively, in the crank chamber 25. A plurality of pistons 18 are reciprocally moveable and accommodated in cylinder bores 11*a*, respectively. A drive plate 15 is mounted on drive shaft 14.

The hinge mechanism is constructed with a pair of arms 15*a* of drive plate 15, connected to pins 16 of swash plate 17. Arms 15*a* are formed on drive plate 15 adjacent to the periphery thereof and project toward the rear direction. Each one of pins 16 includes a ball portion 16*a* which is rotatably engaged with arms 15*a* of drive plate 15. The peripheral portion of swash plate 17 is received via a pair of shoes 20 in recess 18*d* formed in the proximal portions of pistons 18, respectively.

The shoes 20 are slidable along the peripheral portion of swash plate 17. In this way, pistons 18 are retained at the peripheral portion of swash plate 17. As drive plate 15 rotates with drive shaft 14 synchronously, swash plate 17 is rotated with drive plate 15, via the hinge mechanism. Swash plate 17 is rotated with its surfaces inclined with respect to drive shaft 14 and slides in recess 18*d* via the pair of shoes 20, so that pistons 18 reciprocate in cylinder bores 11*a* in accordance with the inclination angle of swash plate 17.

A suction chamber 13*a* and discharge chamber 13*b* are defined by a partition 27 in rear housing 13. Suction ports 23 and discharge ports 24 are provided in valve plate 19. When pistons 18 reciprocate, refrigerant gas is sucked into cylinder bores 11*a* from suction chamber 13*a* through suction ports 23, respectively. After the gas is compressed in cylinder bores 11*a*, it is discharged into discharge chamber 13*b* through discharge ports 24. The difference between the pressure in crank chamber 25 and that in suction chamber 13*a* is adjusted by the opening or closing operation of the control valve mechanism (not shown). Consequently, the stroke of piston 18 is varied. The displacement of the compressor is controlled by regulating the inclination angle of swash plate 17.

In the above mentioned variable capacity swash plate type compressor, it is desirable to reduce the load that is applied to the compressor drive source, e.g., a vehicle engine. To accomplish this, piston 18 is preferably lightweight.

Therefore, each of the pistons 18 has a cylindrical body 18*a* thereof. A first aperture 18*b* and second aperture 18*c* are formed in the peripheral surface of cylindrical body 18*a*. First aperture 18*b* is formed nearer the piston head portion of piston 18 in comparison with second aperture 18*c*. In this arrangement, first aperture 18*b* protrudes from the edge of cylinder bore 11*a* into crank chamber 25 when piston 18 stays in bottom dead center.

The frictional force which is generated by the sliding of swash plate 17 within shoes 20 is transferred to piston 18, urging piston 18 to incline in a radial direction by the moment perpendicular to drive shaft 14 and to the longitudinal axis of piston 18.

As a result, first aperture 18*b* of piston 18 is easily caught on the edge portion of cylinder bore 11*a*. This causes noise and vibration in the compressor, and also abrasion of the piston 18.

SUMMARY OF THE INVENTION

It is an object of the invention to provide a piston type compressor which has a lightweight piston which simultaneously reduces abrasion between the piston and the cylinder bore.

It is another object of the present invention to provide a piston type compressor which has a piston of superior durability.

It is yet another object of the present invention to provide a piston type compressor which reduces noise and vibration.

According to the present invention, a piston type compressor comprises a compressor housing enclosing a crank chamber, a suction chamber, and a discharge chamber therein. The compressor housing includes a cylinder block. A plurality of cylinders are formed in the cylinder block. A plurality of pistons are slidably disposed within each of the cylinders. Each of the pistons includes a main body and an engaging portion axially extending from the cylindrical body. A drive shaft is rotatably supported in the cylinder block. A plate is tiltably connected to the drive shaft. A bearing couples the plate to the pistons so that the pistons are driven in a reciprocating motion within the cylinders upon rotation of the plate.

A first aperture is formed in the cylindrical body of the piston so that the first aperture is near the piston head of the piston. A second aperture is formed in the cylindrical body of the piston so that the second aperture is near the piston end of the piston. The first aperture is positioned so that it remains within the cylinder bore when the piston reciprocates in the cylinder bore.

Further objects, features, and advantages of this invention will be understood from the following detailed description of preferred embodiments with reference to the attached drawings.

DETAILED DESCRIPTION OF PREFERRED EMBODIMENTS

Figure 1:
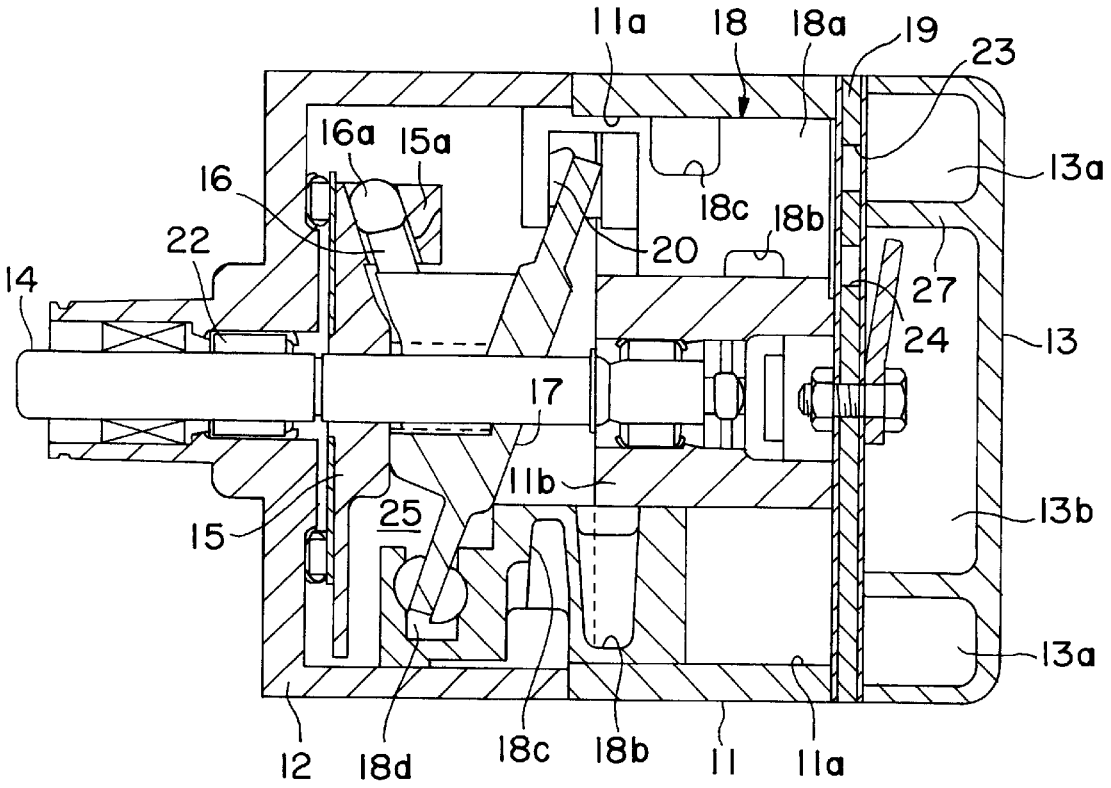
FIG. 1 PRIOR ART
FIG. 1 is a longitudinal cross-sectional view of a swash plate refrigerant compressor with a variable displacement mechanism in accordance with the prior art.
Figure 2:
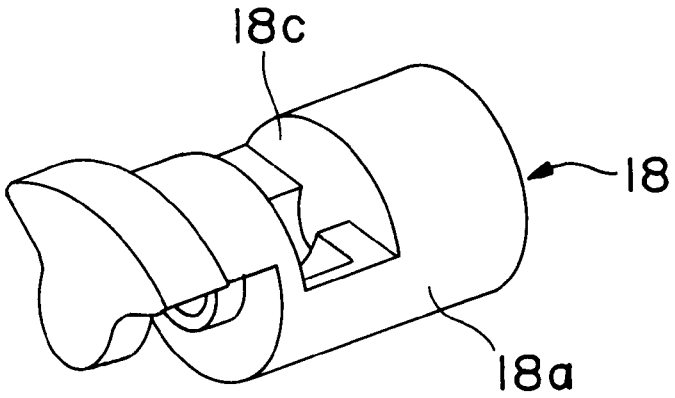
FIG. 2 PRIOR ART
FIG. 2 is a first perspective view of the piston in accordance with the prior art.
Figure 3:
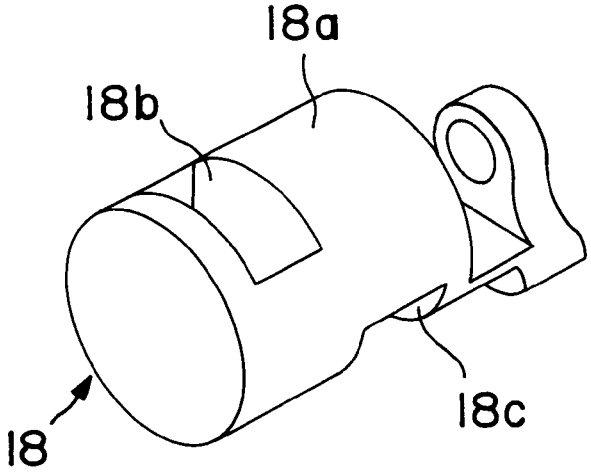
FIG. 3 PRIOR ART
FIG. 3 is a second perspective view of the piston in accordance with the prior art.
Figure 4:
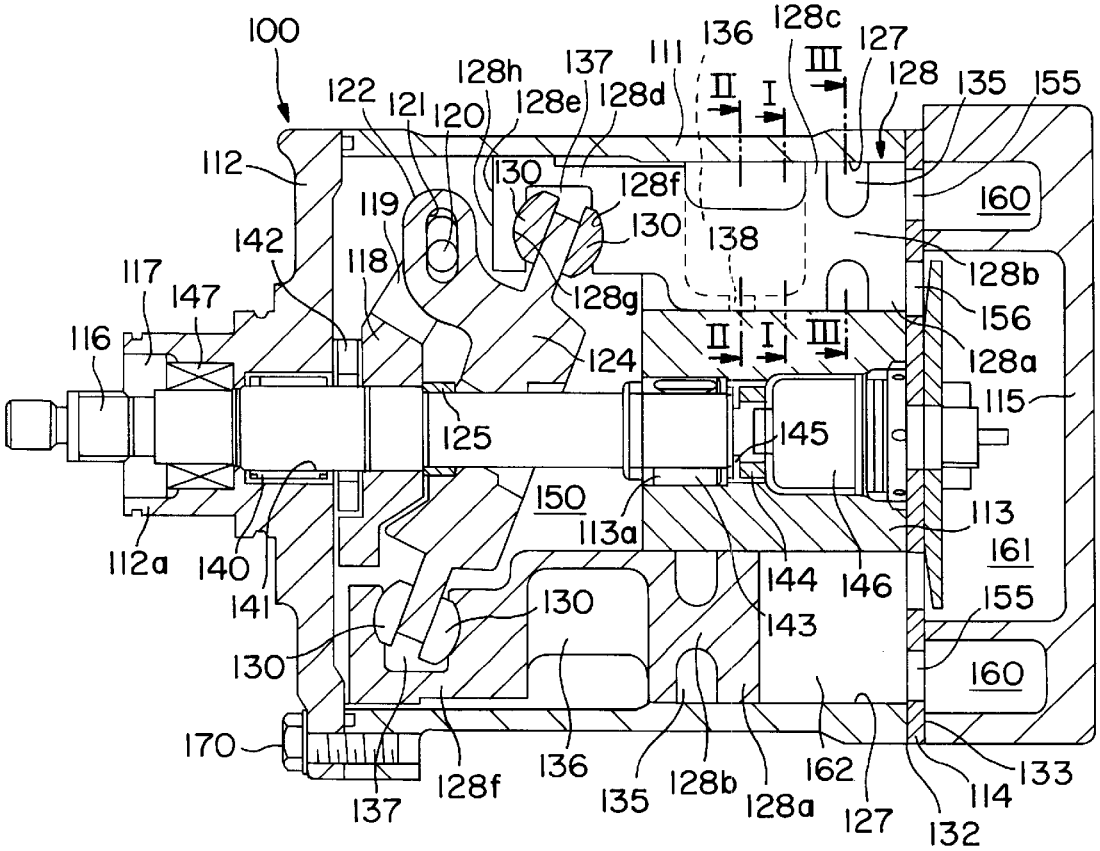
FIG. 4 is a longitudinal cross-sectional view of a swash plate refrigerant compressor with a variable displacement mechanism in accordance with a first embodiment of the present invention.
Figure 5:
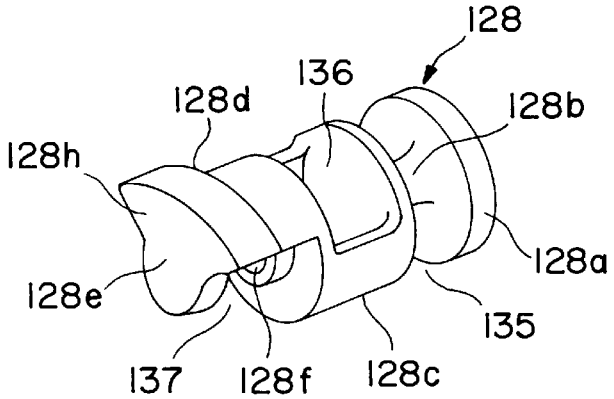
FIG. 5 is a perspective view of the piston in accordance with a first embodiment of the present invention.
Figure 7:
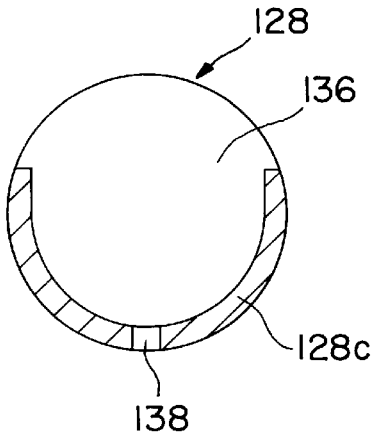
FIG. 7 is a cross-sectional view of the piston taken along the line II—II of FIG. 4.
Figure 6:
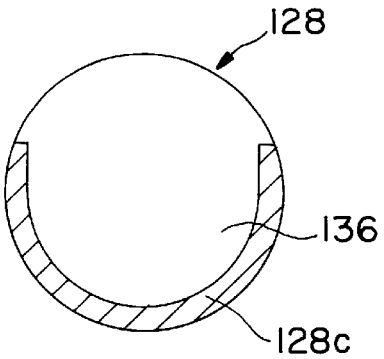
FIG. 6 is a cross-sectional view of the piston taken along the line I—I of FIG. 4.
Figure 8:
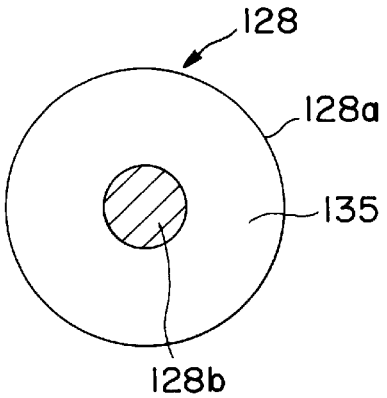
FIG. 8 is a cross-sectional view of the piston taken along the line III—III of FIG.4.

Referring to FIG. 4, a refrigerant compressor according to the present invention is shown.

The compressor, which is generally designated by reference number 100, includes annular cylindrical casing 111, which has a cylinder block 113 on one of its sides and a hollow portion, such as a crank chamber 150. The compressor further includes a front end plate 112 and a rear end plate 115.

Front end plate 112 is mounted on one end opening of annular cylindrical casing 111, to close the end opening of crank chamber 150, and is fixed on annular cylindrical casing 111 by a plurality of bolts 170. Rear end plate 115 and valve plate 114 are mounted on the other end of annular cylindrical casing 111 by a plurality of bolts (not shown) to cover the end portion of cylinder block 113. The annular cylindrical casing 111, cylinder block 113, front end plate 112, valve plate 114, and rear end plate 115 make up the housing of the compressor.

An opening 141 is formed in front end plate 112 which receives drive shaft 116. An annular sleeve 112*a* projects from the front end surface of front end plate 112 and surrounds drive shaft 116 to define a shaft seal cavity 117. A shaft seal assembly 147 is assembled on drive shaft 116 within shaft seal cavity 117.

Drive shaft 116 is rotatably supported by front end plate 112 through bearing 140, which is disposed within opening 141. The inner end of drive shaft 116 is provided with a rotor plate 118. Thrust needle bearing 142 is placed between the inner end surface of front end plate 112 and the adjacent axial end surface of rotor plate 118 to receive the thrust load that acts against rotor plate 118 and ensures smooth motion. The outer end of drive shaft 116, which extends outwardly from annular sleeve 112*a*, is driven by the engine of a vehicle through a conventional pulley arrangement (not shown). The inner end of drive shaft 116 extends into central bore 113*a* formed in the center portion of cylinder block 113 and is rotatably supported therein by a bearing such as radial needle bearing 143. The axial position of drive shaft 116 may be adjusted by adjusting screw mechanism 146 which screws into a threaded portion of central bore 113*a*. A spring device 144 is disposed between the axial end surface of drive shaft 116 and adjusting screw mechanism 146. A thrust needle bearing 145 is placed between drive shaft 116 and spring device 144 to ensure smooth rotation of drive shaft 116.

A coil spring 125 surrounds drive shaft 116 and is placed between the end surface of rotor plate 118 and one axial end surface of swash plate 124 to push swash plate 124 toward cylinder block 113.

Swash plate 124 is connected to rotor plate 118 through a hinge coupling mechanism for rotating in unison with rotor plate 118. In particular, rotor plate 118 may have an arm portion 119 projecting axially outward from one side surface thereof Swash plate 124 may have arm portion 122 projecting from one side surface toward arm portion 119 of rotor plate 118. In this embodiment, arm portion 122 is formed separately from swash plate 124 and is fixed on the side surface of swash plate 124 nearest to arm portion 119 of rotor plate 118.

Arm portions 119 and 122 overlap each other and are connected to one another by a pin 120 which extends into rectangular or oblong shaped hole 121 formed through arm portion 122 of swash plate 124. In this manner, rotor plate 118 and swash plate 124 are hinged to one another. In this construction, pin 120 is slidably disposed in rectangular hole 121, and the sliding motion of pin 120 within rectangular hole 121 changes the slant angle of the inclined surface of swash plate 124.

Cylinder block 113 has a plurality of annularly arranged cylinders 127 in which pistons 128 slide. A cylinder arrangement may include five cylinders, but a smaller or larger number of cylinders may be provided. A plurality of pistons 128 are slidably disposed in cylinders 127.

Swash plate 124 rotates between thrust bearing shoes 130, moving the inclined surface axially to the right and left, thereby reciprocating pistons 128 within cylinders 127. Rear end plate 115 is shaped to define a suction chamber 160 and discharge chamber 161. Valve plate 114, which together with rear end plate 115 is fastened to the end of block 113 by screws, is provided with a plurality of valved suction ports 155 connecting suction chamber 160 and respective cylinders 127, and with a plurality of valved discharge ports 156 connecting discharge chamber 161 and respective cylinder 127. Suction reed valves (not shown) for suction ports 155 and discharge ports 156 are disclosed in U.S. Pat. No. 4,011,029, which is incorporated herein by reference. Gaskets 132 and 133 are placed between cylinder block 113 and valve plate 114, and between valve plate 114 and rear end plate 115 to seal the matching surfaces of cylinder block 113, valve plate 114, and rear end plate 115.

Semi-spherical thrust bearing shoes 130 are disposed between each side surface of swash plate 124 and face semi-spherical pockets 128*f* of arm portion 128*e* for sliding along the side surfaces of swash plate 124 as it rotates between thrust bearing shoes 130, and to move the inclined surface axially to the right and left, thereby reciprocating pistons 128 within cylinders 127.

Referring to FIGS. 4, 5, 6, 7, and 8, each piston 128 comprises a head portion or piston head 128*a* formed at one axial end thereof, cylindrical body 128*c*, cylindrical joint portion 128*b* joining head portion 128*a* with cylindrical body 128*c*, a connecting portion 128*d* extending from the other axial end of cylindrical body 128*c*, and an arm portion 128*e* extending from connecting portion 128*d* at the piston end 128*h*. Cylindrical joint portion 128*b* is formed at radial center of piston 128 such that the outer diameter of cylindrical joint portion 128*b* is concentric with that of cylindrical body 128*c*. Cylindrical joint portion 128*b* has an outer diameter smaller than that of head portion 128*a* or cylindrical body 128*c*. To insure adequate strength, the outer diameter of cylindrical joint portion 128*b* is preferably greater than one quarter of the outer diameter of head portion 128*a*. Accordingly, piston 128 is formed so that there is an annular recessed portion 135 between head portion 128*a* and cylindrical body 128*c*. Further, piston 128 includes an aperture 136 formed in cylindrical body 128*c* so as to scoop or hollow out the interior of cylindrical body 128*c*. Piston 128 includes a pair of semi-spherical pockets 128*f* formed on the inside 128*g* of arm portion 128*e* and on the axial end of cylindrical body 128*c* for engaging semi-spherical thrust bearing shoes 130. Connecting portion 128*d* of piston 128 has a cut out portion 137 which straddles the outer peripheral portion of swash plate 124. Aperture 136 is a rectangular-shaped opening directly into the cylinder bore formed adjacent to the cylinder bore on the radial periphery of cylindrical body 128*c* in such a manner that the radial edge of each opening preferably measures less than one half of the circumference of cylindrical body 128*c*.

Further, piston 128 includes a hole 138 formed in cylindrical body 128*c* such that hole 138 allows direct communication between aperture 136 and the outside of cylindrical body 128*c*. Annular recessed portion 135 and aperture 136 are preferably formed using a die or cutting process.

In operation, drive shaft 116 is rotated by the engine of a vehicle through the pulley arrangement, and rotor plate 118 is rotated together with drive shaft 116. The rotation of the rotor plate is transferred to swash plate 124 through the hinge coupling mechanism so that, with respect to the rotation of rotor plate 118, the inclined surface of swash plate 124 moves axially to the right and left. Consequently, pistons 128, which are operatively connected to swash plate 124 by means of swash plate 124 sliding between bearing shoes 130, reciprocate within cylinders 127. As pistons 128 reciprocate, the refrigerant gas which is introduced into suction chamber 160 from a fluid inlet port (not shown) is taken into each cylinder 127 and compressed. The compressed refrigerant gas is discharged into discharge chamber 161 from each cylinder 127 through discharge port 156 and therefrom into an external fluid circuit, for example, a cooling circuit through the fluid outlet port.

Control of displacement of the compressor can be achieved by varying the stroke of piston 128. The stroke of piston 128 varies depending on the difference between pressures which are acting on both sides of swash plate 124, respectively. The difference is generated by balancing the pressures between the pressure in the crank chamber acting on the rear surface of piston 128 (located at the piston end 128*h*) with the suction pressure in cylinder bore 127 which acts on the front surface of piston 128 (located at piston head 128*a*), and acts on swash plate 124 through piston 128.

When the heat load of the refrigerant gas exceeds a predetermined level, the suction pressure is increased. The pressure in crank chamber 150 is maintained at the suction pressure by a pressure control mechanism (not shown) disposed in cylinder block 113. In this situation, during the compression stroke of pistons 128, the reaction force of gas compression acts against swash plate 124 and is received by the hinge coupling mechanism.

Alternatively, if the heat load is decreased and the refrigerant capacity is exceeded, pressure in suction chamber 160 decreases. In this situation, the pressure in the crank chamber 150 is gradually raised. A narrow pressure differential occurs because blow-by gas, which leaks from working chamber 162 to crank chamber 150 though a gap between piston 128 and cylinder bore 127 during the compression stroke, is contained in crank chamber 150.

Annular recessed portion 135 of piston 128 is designed to stay within cylinder bore 127 even if piston 128 reaches bottom dead center. Annular recessed portion 135 does not protrude from the edge of cylinder bore 127 into crank chamber 150 even when piston 128 stays in bottom dead center.

As a result, unlike prior art pistons, annular recessed portion 135 of piston 128 never gets caught on the edge portion of cylinder bore 127. In addition, because annular recessed portion 135 is formed by scooping out the entire circumference of cylindrical body 128*c*, the total amount of cut out space in piston 128 is maximized.

As a result, piston 128 has a lightweight body and simultaneously reduces noise and vibration of the compressor.

In addition, annular recessed portion 135 and aperture 136 of piston 128 function to store lubricating oil mixed within refrigerant gas. Opening 138 provides lubricating oil, stored in aperture 136, to the inside of cylinder bore 127. This arrangement thereby reduces abrasion between pistons 128 and cylinder bores 127.

Figure 9:
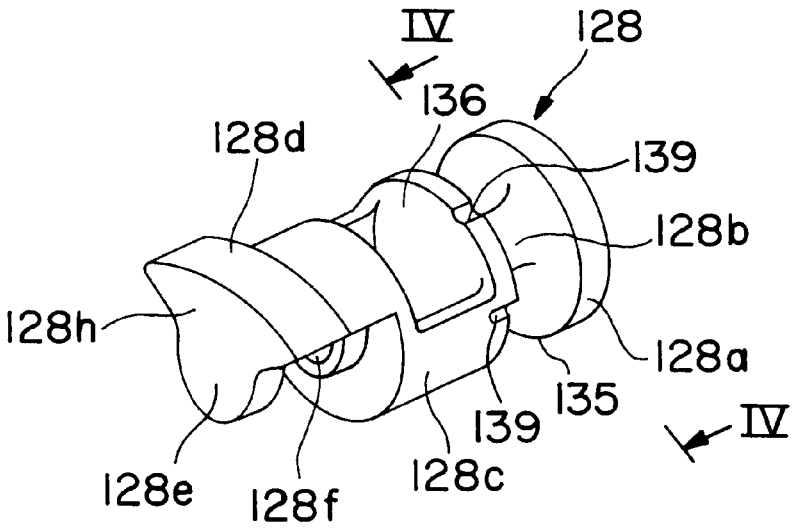
FIG. 9 is a perspective view of the piston in accordance with the second embodiment of the present invention.
Figure 10:
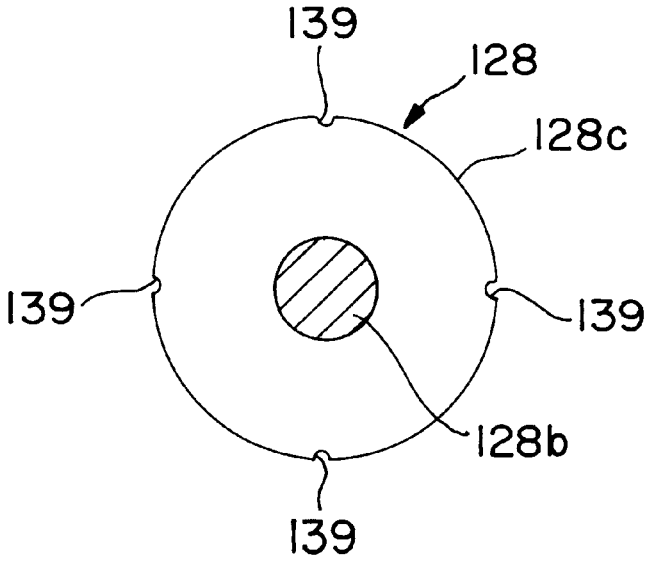
FIG. 10 is a cross-sectional view of the piston taken along the line IV—IV of FIG. 9.

FIGS. 9 and 10 illustrate a second embodiment of the present invention. In FIGS. 9 and 10, the same numerals and letters are used to denote the corresponding elements depicted in FIGS. 4–8 so that further explanation hereof is omitted. FIGS. 9 and 10 illustrate a second embodiment which is similar to the first embodiment except for the following construction. Piston 128 preferably includes a plurality of longitudinal grooves 139 formed on the peripheral surface of cylindrical body 128*c* preferably at equal angular intervals. Preferably, at least one of the grooves 139 allows communication between annular recessed portion 135 and aperture 136. Other grooves 139 extend from one axial end surface to the other axial end surface of cylindrical body 128*c*.

Utilizing this second structure, substantially the same advantages as those in the first embodiment can be obtained. In addition, grooves 139 allow access of lubricating oil, which is stored in annular recessed portion 135 or aperture 136, to the inside of cylinder bore 127. This arrangement also reduces abrasion between pistons 128 and cylinder bores 127.

Although the present invention has been described in connection with the preferred embodiments, the invention is not limited thereto. Specifically, while the preferred embodiments illustrate the invention in a swash plate type compressor, this invention is not restricted to swash plate type refrigerant compressors, but may be employed in other piston type refrigerant compressors or piston type fluid displacement apparatuses. Accordingly, the embodiments and features disclosed herein are provided by way of example only. It will be easily understood by those of ordinary skill in the art that variations and modifications can be easily made within the scope of this invention as defined by the following claims.

We claim:

1. A piston type fluid displacement apparatus comprising:

a housing enclosing a crank chamber, a suction chamber, and a discharge chamber, said housing including a cylinder block, a plurality of cylinder bores formed in said cylinder block;

a drive shaft rotatably supported in said cylinder block;

a plurality of pistons slidably disposed within said cylinder bores, each of said pistons comprising a piston head, a piston end, a cylindrical body and an arm portion at the piston end axially extending from a first axial end of said cylindrical body;

a plate having an angle of tilt and tiltably connected to said drive shaft;

a plurality of bearings coupling said plate to said pistons so that said pistons reciprocate within said cylinder bores upon rotation of said plate;

a first aperture formed in said cylindrical body of said piston so that said first aperture is near the piston head of said piston, said first aperture positioned within said cylinder bore whenever said piston reciprocates in said cylinder bore; and a second aperture formed in said cylindrical body of said piston so that said second aperture is near the piston end of said piston, wherein said second aperture comprises a hollowed-out portion of an interior of said cylindrical body and an opening directly into said cylinder bore, said opening disposed on a radial periphery of said cylindrical body and adjacent said cylinder bore, said first aperture being disposed closer to said piston head than said second aperture.

2. A piston type fluid displacement apparatus comprising:

a housing enclosing a crank chamber a suction chamber and a discharge chamber, said housing including a cylinder block, a plurality of cylinder bores formed in said cylinder block;

a drive shaft rotatable supported in said cylinder block;

a plurality of pistons slidably disposed within said cylinder bores, each of said pistons comprising a piston head, a piston end, a cylindrical body and an arm portion at the piston end axially extending from a first axial end of said cylindrical body;

a plate having an angle of tilt and tiltably connected to said drive shaft;

a plurality of bearings coupling said plate to said pistons so that said pistons reciprocate within said cylinder bores upon rotation of said plate;

a first aperture formed in said cylindrical body of said piston so that said first aperture is near the piston head of said piston, said first aperture positioned within said cylinder bore whenever said piston reciprocates in said cylinder bore, wherein said first aperture is an annular shaped depression formed around a longitudinal axis of said piston; and a second aperture formed in said cylindrical body of said piston so that said second aperture is near the piston end of said piston, wherein said second aperture comprises a hollowed-out portion of an interior of said cylindrical body and an opening directly into said cylinder bore, said opening disposed on a radial periphery of said cylindrical body and adjacent said cylinder bore.

3. The piston type fluid displacement apparatus of claim 2, wherein a communicating path is disposed on said cylindrical body of said piston for fluidly communicating between said first and said second apertures and said cylinder bore.

4. A piston type fluid displacement apparatus comprising:

a housing enclosing a crank chamber, a suction chamber, and a discharge chamber, said housing including a cylinder block, a plurality of cylinder bores formed in said cylinder block;

a drive shaft rotatably supported in said cylinder block;

a plurality of pistons slidably disposed within said cylinder bores each of said pistons comprising a piston head, a piston end a cylindrical body and an arm portion at the piston end axially extending from a first axial end of said cylindrical body;

a plate having an angle of tilt and tiltably connected to said drive shaft;

a plurality of bearings coupling said plate to said pistons so that said pistons reciprocate within said cylinder bores upon rotation of said plate;

a first aperture formed in said cylindrical body of said piston so that said first aperture is near the piston head of said piston, said first aperture positioned within said cylinder bore whenever said piston reciprocates in said cylinder bore;

a second aperture formed in said cylindrical body of said piston so that said second aperture is near the piston end of said piston, wherein said second aperture comprises a hollowed-out portion of an interior of said cylindrical body and an opening directly into said cylinder bore, said opening disposed on a radial periphery of said cylindrical body and adjacent said cylinder bore; and a communicating path disposed on said cylindrical body of said piston for fluidly communicating between said first and said second apertures and said cylinder bore, wherein said communicating path comprises at least one hole between said second aperture and said cylinder bore, allowing increased fluid communication directly between said second aperture and said cylinder bore.

5. A piston type fluid displacement apparatus comprising:

a housing enclosing a crank chamber, a suction chamber, and a discharge chamber, said housing including a cylinder block, a plurality of cylinder bores formed in said cylinder block;

a drive shaft rotatable supported in said cylinder block;

a plurality of pistons slidably disposed within said cylinder bores, each of said pistons comprising a piston head, a piston end, a cylindrical body and an arm portion at the piston end axially extending from a first axial end of said cylindrical body;

a plate having an angle of tilt and tiltably connected to said drive shaft;

a plurality of bearings coupling said plate to said pistons so that said pistons reciprocate within said cylinder bores upon rotation of said plate;

a first aperture formed in said cylindrical body of said piston so that said first aperture is near the piston head of said piston, said first aperture positioned within said cylinder bore whenever said piston reciprocates in said cylinder bore;

a second aperture formed in said cylindrical body of said piston so that said second aperture is near the piston end of said piston, wherein said second aperture comprises a hollowed-out portion of an interior of said cylindrical body and an opening directly into said cylinder bore, said opening disposed on a radial periphery of said cylindrical body and adjacent said cylinder bore; and a communicating path disposed on said cylindrical body of said piston for fluidly communicating between said first and said second apertures and said cylinder bore, wherein said communicating path comprises at least one groove for fluidly communicating between said first aperture and said second aperture.

6. A swash plate type compressor comprising:

a compressor housing enclosing a crank chamber, a suction chamber, and a discharge chamber therein, said compressor housing including a cylinder block;

a plurality of cylinders formed in said cylinder block, each cylinder having an inner surface;

a plurality of pistons, each of which is slidably disposed within said cylinders, each of said pistons having a piston head, a piston end, a cylindrical body, and an engaging portion axially extending towards said piston end from a first axial end of said cylindrical body;

a drive shaft rotatably supported in said cylinder block;

a plate tiltably connected to said drive shaft;

a plurality of bearings coupling said plate to each of said engaging portions of said pistons, so that said pistons reciprocate within said cylinders upon rotation of said plate;

at least one working chamber defined between the piston head of each of said pistons and said inner surface of each of said cylinders;

a support portion disposed coaxially with said drive shaft and tiltably supporting a central portion of said plate;

a first aperture formed in said cylindrical body of said piston so that said first aperture is near the piston head of said piston, said first aperture positioned within said cylinder when said piston reciprocates in said cylinder; and a second aperture formed in said cylindrical body of said piston so that said second aperture is near the piston end of said piston, wherein said second aperture comprises a hollowed-out portion of an interior of said cylindrical body and an opening directly into said cylinder, said opening disposed on a radial periphery of said cylindrical body and adjacent said cylinder, said first aperture being disposed closer to said piston head than said second aperture.

7. A swash plate type compressor comprising:

a compressor housing enclosing a crank chamber, a suction chamber, and a discharge chamber therein, said compressor housing including a cylinder block;

a plurality of cylinders formed in said cylinder block, each cylinder having an inner surface;

a plurality of pistons, each of which is slidably disposed within said cylinders, each of said pistons having a piston head, a piston end, a cylindrical body, and an engaging portion axially extending towards said piston end from a first axial end of said cylindrical body;

a drive shaft rotatable supported in said cylinder block;

a plate tiltably connected to said drive shaft;

a plurality of bearings coupling said plate to each of said engaging portions of said pistons, so that said pistons reciprocate within said cylinders upon rotation of said plate;

at least one working chamber defined between the piston head of each of said pistons and said inner surface of each of said cylinders;

a support portion disposed coaxially with said drive shaft and tiltably supporting a central portion of said plate;

a first aperture formed in said cylindrical body of said piston so that said first aperture is near the piston head of said piston, said first aperture positioned within said cylinder when said piston reciprocates in said cylinder, wherein said first aperture is an annular shaped depression formed around a longitudinal axis of said piston; and a second aperture formed in said cylindrical body of said piston so that said second aperture is near the piston end of said piston, wherein said second aperture comprises a hollowed-out portion of an interior of said cylindrical body and an opening directly into said cylinder, said opening disposed on a radial periphery of said cylindrical body and adjacent said cylinder.

8. The swash plate type compressor of claim 7, wherein a communicating path is disposed on said cylindrical body of said piston for fluidly communicating between said first and said second apertures and said cylinder.

9. A swash plate type compressor comprising:

a compressor housing enclosing a crank chamber, a suction chamber, and a discharge chamber therein, said compressor housing including a cylinder block;

a plurality of cylinders formed in said cylinder block, each cylinder having an inner surface;

a plurality of pistons, each of which is slidably disposed within said cylinders, each of said pistons having a piston head, a piston end, a cylindrical body, and an engaging portion axially extending towards said piston end from a first axial end of said cylindrical body;

a drive shaft rotatable supported in said cylinder block;

a plate tiltably connected to said drive shaft;

a plurality of bearings coupling said plate to each of said engaging portions of said pistons, so that said pistons reciprocate within said cylinders upon rotation of said plate;

at least one working chamber defined between the piston head of each of said pistons and said inner surface of each of said cylinders;

a support portion disposed coaxially with said drive shaft and tiltably supporting a central portion of said plate;

a first aperture formed in said cylindrical body of said piston so that said first aperture is near the piston head of said piston, said first aperture positioned within said cylinder when said piston reciprocates in said cylinder;

a second aperture formed in said cylindrical body of said piston so that said second aperture is near the piston end of said piston, wherein said second aperture comprises a hollowed-out portion of of an interior of said cylindrical body and an opening directly into said cylinder, said opening disposed on a radial periphery of said cylindrical body and adjacent said cylinder; and a communicating path disposed on said cylindrical body of said piston for fluidly communication between said first and said second aperture and said cylinder, wherein said communicating path comprises at least one hole between said second aperture and said cylinder, allowing increased fluid communication directly between said second aperture and said cylinder.

10. A swash plate type compressor comprising:

a compressor housing enclosing a crank chamber, a suction chamber, and a discharge chamber therein, said compressor housing including a cylinder block;

a plurality of cylinders formed in said cylinder block, each cylinder having an inner surface;

a plurality of pistons, each of which is slidably disposed within said cylinders, each of said pistons having a piston head, a piston end, a cylindrical body, and an engaging portion axially extending towards said piston end from a first axial end of said cylindrical body;

a drive shaft rotatably supported in said cylinder block;

a plate tiltably connected to said drive shaft;

a plurality of bearings coupling said plate to each of said engaging portions of said pistons, so that said pistons reciprocate within said cylinders upon rotation of said plate;

at least one working chamber defined between the piston head of each of said pistons and said inner surface of each of said cylinders;

a support portion disposed coaxially with said drive shaft and tiltably supporting a central portion of said plate;

a first aperture formed in said cylindrical body of said piston so that said first aperture is near the piston head of said piston, said first aperture positioned within said cylinder when said piston reciprocates in said cylinder;

a second aperture formed in said cylindrical body of said piston so that said second aperture is near the piston end of said piston, wherein said second aperture comprises a hollowed-out portion of an interior of said cylindrical body and an opening directly into said cylinder, said opening disposed on a radial periphery of said cylindrical body and adjacent said cylinder; and a communicating path disposed on said cylindrical body of said piston for fluidly communication between said first and said second aperture and said cylinder, wherein said communicating path comprises at least one groove for fluidly communicating between said first aperture and said second aperture.

* * * * *